US011573531B2

(12) United States Patent
Charbon

(10) Patent No.: US 11,573,531 B2
(45) Date of Patent: Feb. 7, 2023

(54) PIVOT ARBOR OF A REGULATING MEMBER

(71) Applicant: Nivarox-FAR S.A., Le Locle (CH)

(72) Inventor: Christian Charbon, Chézard-St-Martin (CH)

(73) Assignee: Nivarox-FAR S.A., Le Locle (CH)

( * ) Notice: Subject to any disclaimer, the term of this patent is extended or adjusted under 35 U.S.C. 154(b) by 387 days.

(21) Appl. No.: 16/896,714

(22) Filed: Jun. 9, 2020

(65) Prior Publication Data

US 2021/0103250 A1 Apr. 8, 2021

(30) Foreign Application Priority Data

Oct. 2, 2019 (EP) ..... 19201109

(51) Int. Cl.
*G04B 15/14* (2006.01)
*G04D 3/00* (2006.01)
*G04D 3/02* (2006.01)

(52) U.S. Cl.
CPC ..... *G04B 15/14* (2013.01); *G04D 3/0089* (2013.01); *G04D 3/0254* (2013.01)

(58) Field of Classification Search
CPC ..... G04B 15/14; G04D 3/0089; G04D 3/0254
See application file for complete search history.

(56) References Cited

U.S. PATENT DOCUMENTS 10,761,482 B2 * 9/2020 Charbon ..... G04B 15/14

FOREIGN PATENT DOCUMENTS

| | | | | |
|---|---|---|---|---|
| CH | 713026 A2 * | 4/2018 | ..... | B23K 1/0008 |
| CH | 714492 A2 * | 6/2019 | | |
| CH | 714594 A1 * | 7/2019 | | |
| CH | 714594 A1 | 7/2019 | | |
| KR | 20160021169 A * | 2/2016 | ..... | C22C 30/02 |

OTHER PUBLICATIONS

European Search Report for EP 19 20 1109 dated Mar. 27, 2020.

* cited by examiner

*Primary Examiner* — Edwin A. Leon
*Assistant Examiner* — Kevin Andrew Johnston
(74) *Attorney, Agent, or Firm* — Sughrue Mion, PLLC

(57) ABSTRACT

A timepiece component for a timepiece movement and notably a pivot arbor of a regulating member of a mechanical timepiece movement, made of an alloy containing by weight: between 25% and 55% of palladium, between 25% and 55% of silver, between 10% and 30% of copper, between 0.5% and 5% of zinc, gold and platinum with a total percentage of these two elements comprised between 15% and 25%, between 0% and 1% of one or more elements chosen from among boron and nickel, between 0% and 3% of one or more elements chosen from among rhenium and ruthenium, no more than 0.1% of one or more elements chosen from among iridium, osmium and rhodium, and no more than 0.2% of other impurities, the respective quantities of the components being such that, added together, they do not exceed 100%.

19 Claims, 1 Drawing Sheet

PIVOT ARBOR OF A REGULATING MEMBER

CROSS REFERENCE TO RELATED APPLICATIONS

This application claims priority to European Patent Application No. 19201109.6 filed Oct. 2, 2019, the entire contents of which are incorporated herein by reference.

FIELD OF THE INVENTION

The invention relates to a component for a timepiece movement and particularly to a non-magnetic timepiece component for a mechanical timepiece movement and notably to a non-magnetic balance staff, pallet staff and escape pinion.

BACKGROUND OF THE INVENTION

The manufacture of a timepiece component comprising at least one part taking the form of a turned piece, such as a timepiece pivot arbor, consists in performing chip removal machining operations, such as profile turning, on a hardenable steel bar to define various active surfaces (bearing surface, shoulder, pivots, etc.) and then subjecting the profile-turned arbor to heat treatments including at least one hardening operation to improve the hardness of said component and one or more tempering operations to improve its tenacity. In the case of pivot arbors, the heat treatment operations can be followed by an operation of rolling the pivots of the arbors, which consists in polishing the pivots to the required dimensions. Both the hardness and roughness of the pivots are further improved during the rolling operation. It will be noted that this rolling operation is very difficult or even impossible to achieve with most materials of low hardness, i.e. less than 600 HV.

The pivot arbors, for example the balance staffs, conventionally used in mechanical timepiece movements are made of steel grades for profile turning which are generally martensitic carbon steels containing lead and manganese sulphides to improve their machinability. A known steel of this type, named 20AP, is typically used for these applications.

This type of material has the advantage of being easy to machine, in particular of being suitable for profile turning and, after hardening and tempering, has superior mechanical properties which are very advantageous for making timepiece pivot arbors. These steels have, in particular, high wear resistance and hardness after heat treatment. Typically, the hardness of arbor pivots made of 20AP steel can reach a hardness of more than 700 HV after heat treatment and rolling.

Although providing satisfactory mechanical properties for the horological applications described above, this type of material has the drawback of being magnetic and capable of interfering with the working of a watch after being subjected to a magnetic field, particularly when the material is used to make a balance staff cooperating with a balance spring made of ferromagnetic material. This phenomenon is well known to those skilled in the art. It will also be noted that these martensitic steels are also sensitive to corrosion.

Attempts have been made to try to overcome these drawbacks with austenitic stainless steels, which have the peculiarity of being non-magnetic, i.e. paramagnetic, or diamagnetic or antiferromagnetic. However, these austenitic steels have a crystallographic structure, which means that they cannot be hardened or achieve levels of hardness and thus of wear resistance compatible with the requirements necessary for making timepiece pivot arbors. One means of increasing the hardness of these steels is cold-working, however this hardening operation cannot achieve hardnesses of more than 500 HV. Consequently, for parts requiring high resistance to wear due to friction and requiring pivots which have little or no risk of deformation, the use of this type of steel remains limited.

There is also known from CH Patent Application 714594 pivot arbors made of alloys based on palladium, silver and copper, possibly alloyed with up to 2% of one or more elements chosen from among rhenium, ruthenium, gold or platinum. However, such alloys are sensitive to corrosion, tarnishing and consequently have limited wear resistance.

It is an object of the present invention to overcome all or part of the aforementioned drawbacks by proposing a timepiece component, notably a timepiece pivot arbor and more particularly a pivot arbor of a regulating member of a timepiece movement which both limits sensitivity to magnetic fields and can achieve improved hardness compatible with the wear and shock resistance requirements of the watchmaking industry.

It is also an object of the invention to provide a non-magnetic timepiece component having improved corrosion resistance.

It is yet another object of the invention to provide a non-magnetic timepiece component which can be manufactured simply and economically.

To this end, the invention relates to a timepiece component for a timepiece movement including at least one part machined by chip removal, and notably to a pivot arbor of a regulating member of a mechanical timepiece movement made from an alloy containing (or consisting of) by weight:

between 25% and 55% of palladium,
between 25% and 55% of silver,
between 10% and 30% of copper,
between 0.5% and 5% of zinc, gold and platinum with a total percentage of these two elements comprised between 5% and 25%,
between 0% and 1% of one or more elements chosen from among boron and nickel,
between 0% and 3% of one or more elements chosen from among rhenium and ruthenium,
no more than 0.1% of one or more elements chosen from among iridium, osmium and rhodium, and
no more than 0.2% of other impurities, the respective quantities of the components being such that, together, they add up to 100%.

Such a timepiece component makes it possible to combine advantages such as low sensitivity to magnetic fields, hardness, and good corrosion resistance, while still maintaining good general tenacity. Moreover, the use of a non-magnetic alloy as defined above is advantageous given that the latter has good machinability. Furthermore, owing to the selected proportion of rhenium, ruthenium, gold and/or platinum, the component is given self-lubricating properties which are particularly advantageous for the production of timepiece arbors. Indeed, the sum of these elements, which is greater than or equal to 15% by weight, makes it possible to improve resistance to oxidation, which results in improved wear resistance of the part of the component in friction with another component, particularly dry friction. In particular, better wear resistance is observed of the pivots of the timepiece arbor typically in friction with the ruby in a bearing.

Advantageously, the alloy contains by weight:
between 30% and 40% of palladium,
between 25% and 35% of silver,
between 10% and 18% of copper,
between 0.5% and 1.5% of zinc, gold and platinum with a total percentage of these two elements comprised between 16% and 24%, and more preferably between 8 and 12% of gold and 8 and 12% of platinum with a total percentage of rhenium and ruthenium comprised between 0 and 6% by weight.

According to a preferred embodiment, the alloy of the invention contains by weight 35% of palladium, 30% of silver, 14% of copper, 10% of gold, 10% of platinum and 1% of zinc.

It is possible to improve the hardness of at least the part machined by chip removal.

According to a first variant, at least the part machined by chip removal is heat treated by a precipitation type treatment, i.e. a treatment allowing the controlled release of components to form precipitated aggregates (structural hardening), such a treatment makes it possible to achieve hardnesses on the order of 290 HV.

According to another variant, at least the part machined by chip removal undergoes a mechanical rolling treatment followed by a structural hardening heat treatment; such a treatment makes it possible to achieve hardnesses on the order of 370 HV.

According to yet another variant, at least the part machined by chip removal includes a hardening layer deposited on an outer surface of said part.

Finally, the invention relates to a method for manufacturing a timepiece component for a timepiece movement comprising at least one part machined by chip removal and, in particular, to a pivot arbor of a regulating member of a mechanical timepiece movement, the method comprising the following steps:

a) taking an element machinable by chip removal, said element being made of a non-magnetic alloy containing by weight: between 25% and 55% of palladium, between 25% and 55% of silver, between 10% and 30% of copper, between 0.5% and 5% of zinc, gold and platinum with a total percentage of these two elements comprised between 15% and 25%, between 0% and 1% of one or more elements chosen from among boron and nickel, between 0% and 3% of one or more elements chosen from among rhenium and ruthenium, at most 0.1% of one or more elements chosen from among iridium, osmium and rhodium, and at most 0.2% of other impurities, the respective quantities of the components being such that, together, they add up to 100% b) chip removal machining said timepiece component to form at least the part of said timepiece component that is machined by chip removal and made of said non-magnetic alloy.

To improve the hardness of at least the part machined by chip removal, the method of the invention may include, according to a variant, a step e) of depositing a hardening layer on at least an outer surface of said part machined by chip removal.

Alternatively, and as mentioned above, the method of the invention can include a structural hardening treatment step of the chip removal machinable element, typically an element in the form of a bar, or a structural hardening treatment of the timepiece component produced by the machining process.

According to yet another alternative, the method of the invention can include a step of mechanical cold-working of the chip removal machinable element, typically an element in the form of a bar, followed by a step of structural hardening of this machinable element or a structural hardening of the timepiece component produced by the machining of the cold-worked machinable element.

BRIEF DESCRIPTION OF THE DRAWINGS

Other features and advantages will appear clearly from the following description, given by way of non-limiting illustration, with reference to the annexed drawings, in which:

FIG. 2 is a partial sectional view of one of the pivots of the arbor of FIG. 1.

DETAILED DESCRIPTION OF PREFERRED EMBODIMENTS

In the present description, the term "non-magnetic" alloy means a paramagnetic or diamagnetic or antiferromagnetic alloy, whose magnetic permeability is less than or equal to 1.01.

The term "chip removal machining" means any shaping operation by a material removal process intended to give a component dimensions and a surface finish within a given tolerance range. Such operations are, for example, profile turning, milling or any other technique known to those skilled in the art.

The invention relates to a component for a timepiece movement and particularly to a non-magnetic timepiece component, such as a pivot arbor, for a mechanical timepiece movement.

Figure 1:
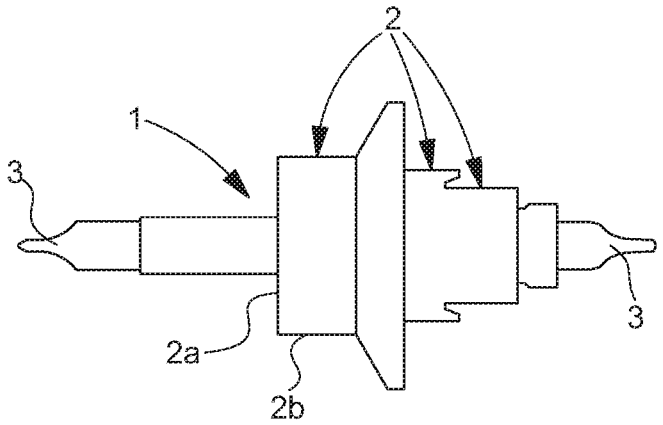
FIG. 1 is a representation of a timepiece component, and more precisely of a balance staff, according to the invention.

The invention will be described below in the context of application to a non-magnetic balance staff 1 as represented in FIG. 1. Of course, other types of timepiece pivot arbors can be envisaged, such as, for example, timepiece wheel arbors, typically escape pinions, or pallet staffs. Components of this type have a body with a diameter preferably less than 2 mm, and pivots with a diameter preferably less than 0.2 mm, with a precision of several microns. Other timepiece components that can be envisaged are screws, winding stems, balance spring studs, etc., and may have similar dimensions to those mentioned above for the arbors.

Referring to FIG. 1, there is shown a balance staff 1 according to the invention, which includes a plurality of sections 2 of different diameters, preferably formed by profile turning or any other chip removal machining technique, and defining, in a conventional manner, bearing surfaces 2*a* and shoulders 2*b* arranged between two end portions defining two pivots 3. These pivots are each intended to pivot in a bearing, typically in an orifice in a jewel or ruby.

According to the invention, at least one part of the timepiece component, and, in the example illustrated at least one pivot 3, is made of a non-magnetic metal alloy 4 in order to limit its sensitivity to magnetic fields. This alloy contains or includes by weight:
between 25% and 55% of palladium,
between 25% and 55% of silver,
between 10% and 30% of copper,
between 0.5% and 5% of zinc, gold and platinum with a total percentage of these two elements comprised between 15% and 25%,
between 0% and 1% of one or more elements chosen from among boron and nickel,
between 0% and 3% of one or more elements chosen from among rhenium and ruthenium,
no more than 0.1% of one or more elements chosen from among iridium, osmium and rhodium, and
no more than 0.2% of other impurities, the respective quantities of the components being such that, added together, they do not exceed 100%.

Advantageously, the alloy contains or includes by weight:
between 30% and 40% of palladium,
between 25% and 35% of silver,
between 10% and 18% of copper,
between 0.5% and 1.5% of zinc,
between 8 and 12% of gold and 8 and 12% of platinum, with a proportion of rhenium and ruthenium comprised between 0 and 6% by weight.

According to a still more preferred embodiment, the alloy of the invention contains by weight:
between 34% and 36% of palladium,
between 29% and 31% of silver,
between 13.5% and 14.5% of copper,
between 0.8% and 1.2% of zinc,
between 9.5% and 10.5% of gold
between 9.5% and 10.5% of platinum,
no more than 0.1% of one or more elements chosen from among iridium, osmium, rhodium and ruthenium and
no more than 0.2% of other impurities, the respective quantities of the components being such that, together, they add up to 100%.

According to a still more preferred embodiment, the alloy of the invention contains by weight 35% of palladium, 30% of silver, 14% of copper, 10% of gold, 10% of platinum and 1% of zinc. The present invention also relates to the method for manufacturing the timepiece component for a timepiece movement and, in particular, the pivot arbor of a regulating member of a mechanical timepiece movement comprising the following steps:

a) taking an element machinable by chip removal, said element being made of a non-magnetic alloy containing by weight: between 25% and 55% of palladium, between 25% and 55% of silver, between 10% and 30% of copper, between 0.5% and5% of zinc, gold and platinum with a total percentage of these two elements comprised between 15% and 25%, between 0% and 1% of one or more elements chosen from among boron and nickel, between 0% and 3% of one or more elements chosen from among rhenium and ruthenium, at most 0.1% of one or more elements chosen from among iridium, osmium and rhodium, and at most 0.2% of other impurities, the respective quantities of the components being such that, together, they add up to 100% b) chip removal machining said timepiece component to form at least one part of said timepiece component that is machined by chip removal and made of said non-magnetic alloy.

The method may also include, after the machining step b), a surface finish treatment step c) such as rolling and/or polishing.

The method can also include a heat treatment step d) typically a structural hardening treatment, intended to increase the hardness of the alloy to a hardness comprised between 350 and 550 HV1. This heat treatment is performed at a temperature comprised between 350 and 450° C. for a time comprised between 30 minutes and 3 hours, more particularly between 30 minutes and 1 hour 30 minutes.

The structural hardening heat treatment of step d) can be performed before step b) (directly on the chip removal machinable element made of the non-magnetic alloy of the invention, typically in the form of a bar) if the machining process requires high hardness. However, it is preferably performed after the machining of step b) and before step c).

The heat treatment of step d) can be preceded by a mechanical cold working treatment of the chip removal machinable element made of the non-magnetic alloy of the invention, typically in the form of a bar.

Figure 2:
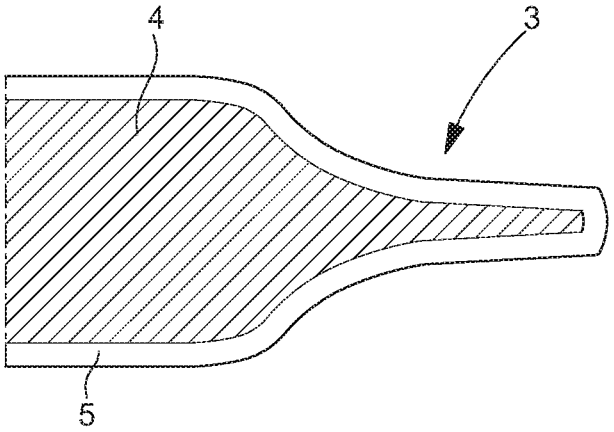
FIG. 2 is a partial sectional view of a part machined by chip removal of the timepiece component according to a variant of the invention, after an operation of depositing a hardening layer and after a rolling or polishing operation. More precisely.

Referring to FIG. 2, the method can also include a step e) of depositing a hardening layer 5 at least on an outer surface of said part 3 machined by chip removal in step b) before or after step c) and after step d) where appropriate. Preferably, the hardening layer is made of a material chosen from among the group including Ni and NiP.

The phosphorus content can be comprised between 0 (thus pure Ni) and 15% by weight. Preferably, the phosphorus content is either medium and comprised between 6 and 9% by weight, or high and comprised between 9 and 12% by weight. Deposition of the hardening layer can be performed by PVD, CVD, ALD, electroplating and chemical deposition, and preferably by chemical deposition. Preferably, layer 5 has a thickness comprised between 0.5 and 10 μm, preferably between 1 and 5 μm and more preferably between 1 and 2 μm. This hardening layer makes it possible to obtain excellent shock resistance in the main stress areas.

The invention claimed is:

1. A timepiece component for a timepiece movement, made of an alloy comprising by weight:
between 25% and 55% of palladium,
between 25% and 55% of silver,
between 10% and 30% of copper,
between 0.5% and 5% of zinc,
between 5% and 25% of one or more elements chosen from among gold and platinum,
between 0% and 1% of one or more elements chosen from among boron and nickel,
between 0% and 3% of one or more elements chosen from among rhenium and ruthenium,
no more than 0.1% of one or more elements chosen from among iridium, osmium and rhodium, and
no more than 0.2% of other impurities, the respective quantities of the components being such that, together, they add up to 100%.

2. The timepiece component according to claim 1, wherein the alloy contains by weight between 30% and 40% of palladium.

3. The timepiece component according to claim 1, wherein the alloy contains by weight between 25% and 35% of silver.

4. The timepiece component according to claim 1, wherein the alloy contains by weight between 10% and 18% of copper.

5. The timepiece component according to claim 1, wherein the alloy contains by weight between 0.5% and 1.5% of zinc.

6. The timepiece component according to claim 1, wherein the alloy contains gold and platinum with a total percentage by weight of said two elements comprised between 16% and 24%.

7. The timepiece component according to claim 1, wherein the alloy contains by weight between 8 and 12% of gold and 8 and 12% of platinum.

8. The timepiece component according to claim 1, made of an alloy containing by weight:

between 34% and 36% of palladium,
between 29% and 31% of silver,
between 13.5% and 14.5% of copper,
between 0.8% and 1.2% of zinc,
between 9.5% and 10.5% of gold
between 9.5% and 10.5% of platinum,
no more than 0.1% of one or more elements chosen from among iridium, osmium, rhodium and ruthenium and
no more than 0.2% of other impurities, the respective quantities of the components being such that, together, they add up to 100%.

9. The timepiece component according to claim 1, wherein the component comprises at least one part machined by chip removal, said part comprising a hardening layer on the external surface thereof.

10. The timepiece component according to claim 9, wherein the hardening layer is made of a material chosen from the group including Ni and NiP.

11. The timepiece component according to claim 1, wherein said arbor is a balance staff, a pallet staff or an escape wheel arbor.

12. The timepiece component according to claim 1, wherein the alloy has a Vickers hardness of 350 HV to 550 HV.

13. A mechanical movement for a timepiece, wherein the movement includes a timepiece component for a timepiece movement, made of an alloy comprising by weight:

between 25% and 55% of palladium,
between 25% and 55% of silver,
between 10% and 30% of copper,
between 0.5% and 5% of zinc,
between 5% and 25% of one or more elements chosen from among gold and platinum,
between 0% and 1% of one or more elements chosen from among boron and nickel,
between 0% and 3% of one or more elements chosen from among rhenium and ruthenium,
no more than 0.1% of one or more elements chosen from among iridium, osmium and rhodium, and
no more than 0.2% of other impurities, the respective quantities of the components being such that, together, they add up to 100%.

14. A method for manufacturing a timepiece component for a timepiece movement, comprising at least one part machined by chip removal, the method comprising the following steps:

a) taking an element machinable by chip removal, said element being made of a non-magnetic alloy containing by weight: between 25% and 55% of palladium, between 25% and 55% of silver, between 10% and 30% of copper, between 0.5% and 5% of zinc, between 15% and 25% of one or more elements chosen from among gold and platinum, between 0% and 1% of one or more elements chosen from among boron and nickel, between 0% and 3% of one or more elements chosen from among rhenium and ruthenium, at most 0.1% of one or more elements chosen from among iridium, osmium and rhodium, and at most 0.2% of other impurities, the respective quantities of the components being such that, together, they add up to 100% b) chip removal machining said timepiece component.

15. The manufacturing method according to claim 14, wherein the method further includes a heat hardening step c).

16. The manufacturing method according to claim 15, wherein the heat hardening step c) is performed at a temperature comprised between 350° C. and 450° C. for a time comprised between 30 minutes and 3 hours.

17. A method according claim 15, wherein the method further includes a step d) of depositing a hardening layer at least on an outer surface of said at least one part.

18. The method according to claim 17, wherein hardening layer is made of a material chosen from a group including Ni and NiP.

19. The method according to claim 17, wherein the method includes a rolling and/or polishing step e) performed on said at least one part after step b), after step c) or after step d).

* * * * *